United States Patent [19]

Morishita et al.

[11] Patent Number: 4,926,705

[45] Date of Patent: May 22, 1990

[54] STARTER DEVICE FOR INTERNAL COMBUSTION ENGINES

[75] Inventors: Akira Morishita; Toshinori Tanaka; Shuzoo Isozumi, all of Himeji, Japan

[73] Assignee: Mitsubishi Denki Kabushiki Kaisha, Tokyo, Japan

[21] Appl. No.: 253,643

[22] Filed: Oct. 5, 1988

[30] Foreign Application Priority Data

Oct. 7, 1987 [JP] Japan ..... 62-153526[U]
Nov. 6, 1987 [JP] Japan ..... 62-170612[U]

[51] Int. Cl.[5] ..... F02N 11/00

[52] U.S. Cl. ..... 74/6; 74/7 R; 123/179 M

[58] Field of Search ..... 74/6, 7 R, 7 A; 123/179 M

[56] References Cited

U.S. PATENT DOCUMENTS

| | | | |
|---|---|---|---|
| 3,171,284 | 3/1965 | Scherzinger | 123/179 M |
| 3,210,554 | 10/1965 | Seilly et al. | 74/7 R |
| 4,325,265 | 4/1982 | Wakatsuki et al. | 74/7 R |
| 4,412,457 | 11/1983 | Colvin et al. | 74/7 A |
| 4,433,652 | 2/1984 | Holtzberg et al. | 123/188 AA |
| 4,453,505 | 6/1984 | Holtzberg et al. | 123/90.61 |
| 4,553,417 | 11/1985 | Badger | 427/318 |
| 4,808,441 | 2/1989 | Chattha et al. | 427/386 |

FOREIGN PATENT DOCUMENTS

| | | | |
|---|---|---|---|
| 2053845 | 5/1970 | Fed. Rep. of Germany | 74/6 |

*Primary Examiner*—Leslie A. Braun

*Assistant Examiner*—Scott Anchell

*Attorney, Agent, or Firm*—Sughrue, Mion, Zinn, Macpeak & Seas

[57] ABSTRACT

A starter device for an internal combustion engine comprises an output shaft driven by a motor, and a hollow cylindrical assembly disposed coaxially around and axially slidably on the output shaft, which assembly includes a hollow shaft splined to the output shaft, and a hollow cylinder disposed at the front side of the hollow shaft and coupled thereto through an overrunning clutch which transmits a rotational force in one rotational direction. Integrally formed at the front end of the hollow cylinder is a pinion which is placed into driving engagement with a ring gear of the associated engine when the axially slidable assembly is slid to a front position by a shift lever which urges the clutch to move in the axial direction. According to one aspect of the present invention, an annular sealing member is interposed between the hollow cylinder and the output shaft at an axial position in front of the sleeve bearing which rotatably supports the hollow shaft around the output shaft. According to another aspect, the outer circumferential surface of the output shaft is provided with an organic coating, which is formed of a resin such as a fluorocarbon resin or an epoxy resin, along an axial length which is situated in front of the sleeve bearing of the hollow cylinder when the hollow cylinder is at the front position. The resin-coated portion of the output shaft includes at least the portion which projects from the front end of the hollow cylinder when the hollow cylinder is at the rear position.

10 Claims, 4 Drawing Sheets

STARTER DEVICE FOR INTERNAL COMBUSTION ENGINES

BACKGROUND OF THE INVENTION

1. Field of the Invention

The present invention relates to a starter device for internal combustion engines of automotive vehicles, and more particularly to an output structure thereof.

2. Description of the Related Art

FIG. 1 shows the output structure of a conventional starter device for the internal combustion engine of automobiles. The starter device, generally designated by reference numeral 1, comprises a front housing frame 2*a* and a rear housing frame 2*b* coupled to each other to form the housing of the device. The output structure of the starter comprises an output shaft 3 which is operatively connected with and driven by a motor, and an axially slidable hollow cylindrical assembly disposed coaxially around and driven by the shaft 3. The output shaft 3 may be a rotary shaft of a motor. The axially slidable assembly comprises a hollow shaft 4, an overrunning clutch 5, a pinion-carrying hollow cylinder 6, and a pinion 6*a*, and is slidable on the shaft 3 in the axial direction between a front position at which the pinion 6*a* engages a ring gear 7 of an engine (not shown) and a rear position at which the pinion 6*a* is out of engagement therewith.

The output shaft 3 rotatably supported by the housing has a stopper 3*a* fixed at the front end thereof to limit the axial translation of the axially slidable assembly. The enlarged diameter portion 3*b*, which is formed on the shaft 3 at an axial position thereof which is situated at the rear of the overrunning clutch 5 when the clutch 5 is in the rear position, has helical splines formed at the outer circumferential surface thereof. A portion 3*c* of the shaft 3 in front of a step at the front end of an enlarged diameter portion 3*b* is plated, for example, with chromium, to prevent the development of rust, etc.

The axially slidable assembly, on the other hand, is constructed as follows. The hollow shaft 4 engages the output shaft 3 by means of helical keyways which are formed in the interior surface thereof and mesh with the helical splines formed on the enlarged diameter portion 3*b* of the shaft 3. Thus, the hollow shaft 4 is slidable on the shaft 3 in the axial direction. The overrunning clutch 5 comprises an outer member 5*a* integral with the hollow shaft 4, an inner member 5*c* integral with the pinion carrying hollow cylinder 6, and a friction rollers 5*b* interposed therebetween to transmit a rotational driving force in one rotational direction. The pinion-carrying hollow cylindrical member 6 is rotatably supported by the shaft 3 by means of a sleeve bearing 6*b* which is fitted on the interior circumferential surface of the pinion-carrying cylinder 6 and is slidable on the shaft 3 in the axial direction. Further, the pinion-carrying cylinder 6 is rotatably supported by the front housing frame 2*a* through a ball bearing 2*c* to be slidable in the axial direction. The shift lever 8 slides the overrunning clutch 5 along the shaft 3 in the axial direction.

The operation of the starter device of FIG. 1 is as follows. When the internal combustion engine (not shown) is to be started, the shift lever 8 is activated to move the slidable output assembly (including the hollow shaft 4, the overrunning clutch 5 and the pinion-carrying cylinder 6) to the front limit position at which the front end of the pinion-carrying cylinder 6 abuts the stopper 3*a* and the pinion 6*a* engages the ring gear 7 of the engine. When the motor is energized, the rotational force of the output shaft 3, which is operatively connected with and driven by the motor or which may be the rotary shaft of the motor, is transmitted to the hollow shaft 4 splined thereto, and thence to the pinion-carrying cylinder 6 through the overrunning clutch 5. Thus, the pinion 6*a* engaging with the ring gear 7 drives and rotates it to start the engine. After the engine is thus started, the slidable output assembly including the pinion carrying cylinder 6 returns to its rear position.

The output structure of the starter of FIG. 1 has following disadvantage. The plating on the outer circumferential surface of the portion 3*c* of the output shaft 3 which slidably supports the hollow cylinder 6 may come off in a relatively short time to develop rust thereon at exposed portions, due to the extremely severe environmental condition under which the portion 3*c* is; when this happens, the sliding movement of the pinion-carrying cylinder 6 on the shaft 3 is obstructed.

FIG. 2 shows a modified output structure of a starter device. A cap-shaped cover 9 is detachably fitted on an annular projection 6*c* formed at the front end of the pinion-carrying hollow cylinder 6, the cover 9 being coupled to the cylinder 6 at the open end portion thereof to close an opening 6*f* of the hollow cylinder 6 to the exterior space, and the inwardly turned annular end portion of the cap 9 being fitted into an annular groove 6*d*formed at the base of the projection 6*c*. The cover 9, which is moved with the pinion-carrying hollow cylinder 6 and has an axial length enough to accommodate the front portion of the output shaft 3 even when the pinion-carrying hollow cylinder 6 is retracted to its rear limit position, closes the opening 6*f* of the hollow cylinder 6 and prevents dust, foreign matter, etc., from entering into the interior of the opening 6*f*, thereby enhancing the durability of the sleeve bearings 6*b* and the portion 3*c* of the shaft 3 which slidably supports the hollow cylinder 6. Apart from the cover 9, the projection 6*c* and the groove 6*d* formed at the front end of the hollow cylinder 6, the output structure of FIG. 2 is similar to that shown in FIG. 1 except that the structure of FIG. 2 comprises an annular oil seal 2*d* interposed between the front housing frame 2*a* and the pinion-carrying hollow cylinder 6, and, further, that two sleeve bearings 6*b* instead of one are interposed between the shaft 3 and the hollow cylinder 6.

The output structure of the starter device shown in FIG. 2 suffers from following disadvantages:

(a) When the pinion 6*a* is in engagement with the ring gear 7 of the engine and the pinion-carrying hollow cylinder 6 is driven by the engine at a high speed, the cover 9 may be disengaged from the pinion-carrying cylinder 6, or damaged, due to the centrifugal force resulting from the rotation.

(b) When the starter device is to be attached to the engine, the cover 9 may be damaged by being struck by surrounding devices, etc.; in such cases, its proper function as a dust preventing cover may be lost, or a concave deformation resulting from the damage may obstruct the sliding movement of the pinion-carrying cylinder 6 on the shaft 3.

(c) The cover 9 moves forward with the pinion-carrying hollow cylinder 6 to project further forward from the front end of the output shaft 3 when the hollow cylinder 6 is slid to the front limit position. Thus, an additional space is needed for the cover 9 in front of the front end of the output shaft 3. Consequently, the starter device requires wider space in the engine room of the vehicle for its installation.

SUMMARY OF THE INVENTION

Thus, a primary object of the present invention is to provide a starter device for an internal combustion engine which is free from the disadvantages of the abovementioned conventional devices. More particularly, the present invention aims at providing a starter device in which the durability of the output shaft and of the bearing for the pinion-carrying hollow cylinder are enhanced.

Another object of the present invention is to provide a starter device which requires smaller space for installation.

A further object of the present invention is to provide a starter device which has a simple structure and which can be produced at low cost.

According to one aspect of the present invention, a starter device for an internal combustion engine is provided which comprises: a housing; drive means in the form of a motor; an output shaft operatively connected with and driven by the motor; a hollow shaft splined to the output shaft so that the hollow shaft is slidable in the axial direction while being driven by the output shaft; a pinion-carrying hollow cylinder disposed coaxially around the output shaft at the front side of the hollow shaft; a pinion formed at the front end of the hollow cylinder which is placed into engagement with a ring gear of the associated internal combustion engine to drive it when the hollow cylinder is translated to the front position; a bearing in the form of a sleeve bearing rotatably supporting the hollow cylindrical member around the output shaft and being slidable on the output shaft in the axial direction to allow axial translation of the pinion-carrying hollow cylinder; a one-way clutch coupling the hollow shaft to the pinion-carrying hollow cylinder to transmit a rotational force in one rotational direction; means for sliding an axially slidable assembly (i.e., the hollow shaft and the pinion-carrying hollow cylinder coupled to each other by the one-way clutch) in the axial direction on the output shaft; and an annular sealing member in the form of an oil seal disposed between the inner circumferential surface of the pinion-carrying hollow cylinder and the outer circumferential surface of the output shaft. The sealing member is disposed coaxially around the output shaft at an axial position in front of the hollow-cylinder-supporting bearing. Thus, the sealing member substantially closes the front end opening of the pinion-carrying hollow cylinder and prevents water, dust and the like from entering therethrough the interior thereof. Consequently, the durability of the bearing and of the output shaft is enhanced.

According to another aspect of the present invention, a starter device for an internal combustion engine is provided which has a structure similar to that according to the first aspect. According to this aspect, however, instead of interposing the annular sealing member between the pinion-carrying hollow cylinder and the output shaft to protect the bearing and the outer circumferential surface of the output shaft, the outer circumferential surface of the output shaft is provided with a rust-preventive coating formed of an organic material such as a fluorocarbon resin or an epoxy resin, along an axial length which is situated axially in front of the bearing of the pinion-carrying hollow cylinder when the hollow cylinder is at the front limit position. The axial length provided with the rust-preventive coating includes at least the portion of the output shaft which projects from the front end of the hollow cylinder when the hollow cylinder is at the rear limit position. The resin-coated surface portion includes substantially all the area of the surface of the output shaft on which rust would develop. Thus, the development of rust on the outer surface of the output shaft can be effectively prevented by the organic coating; consequently, sliding difficulty of the pinion-carrying hollow cylinder resulting from rust can be prevented.

BRIEF DESCRIPTION OF THE DRAWINGS

Further details of the present invention will become more clear from the detailed description of a few preferred embodiments thereof, taken in conjunction with the accompanying drawings, in which.

In the drawings, like reference numerals and characters represent like or corresponding parts or portions.

DETAILED DESCRIPTION OF THE PREFERRED EMBODIMENTS

Figure 3:
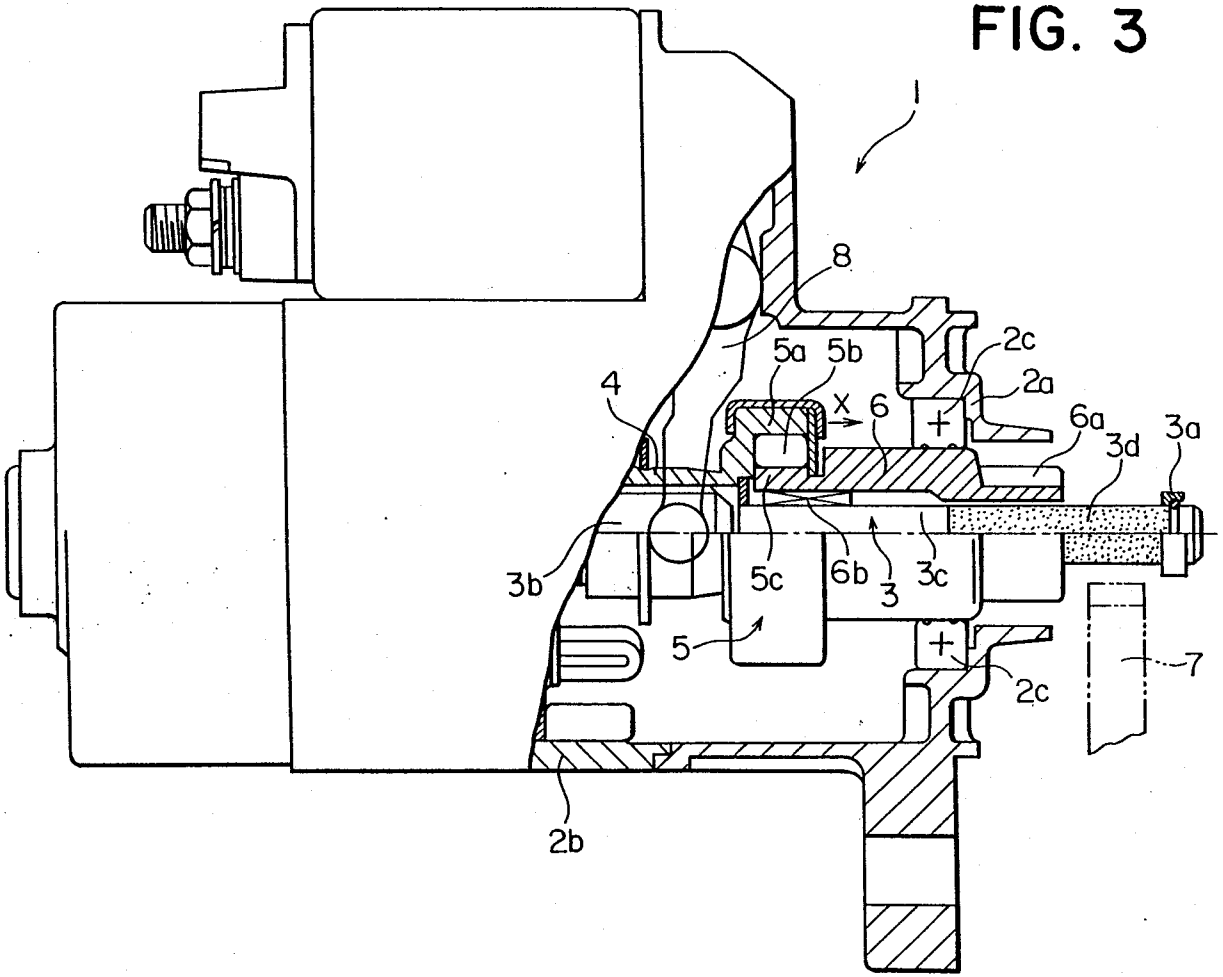
FIG. 3 is a view similar to that of FIG. 1, but showing the output portion of a starter device according to the present invention.

Referring now to FIG. 3 of the drawings, a first embodiment according to the present invention is described.

Figure 1:
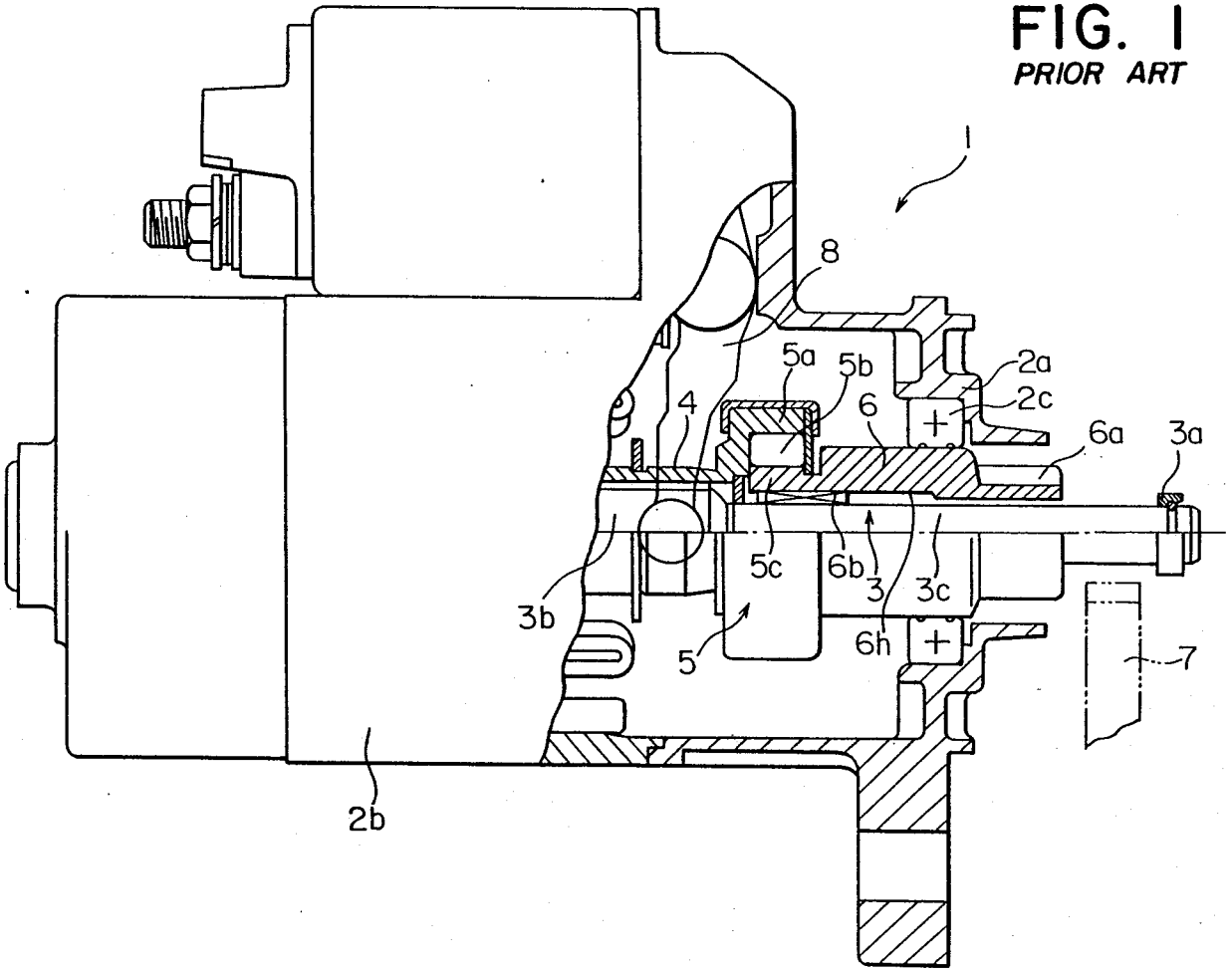
FIG. 1 PRIOR ART
FIG. 1 is a partially cutaway view of a conventional starter device for an internal combustion engine, showing the output structure thereof partially in cross section.

The starter device 1 for the internal combustion engine of an automotive vehicle illustrated in FIG. 3 has a structure similar to that of the starter device of FIG. 1, except for the resin coating on an output shaft 3 thereof.

Thus, the output shaft 3, being driven by a motor and rotatably supported by a housing which is constituted by a front housing frame **2*a* and a rear housing frame 2*b*, comprises a ring-shaped stopper 3*a* fixed to the front end portion thereof for limiting the axial translation of a pinion-carrying cylinder 6, and an enlarged diameter portion 3*b*, which is situated axially at the rear of an overrunning clutch 5 when the clutch 5 is at its rear position and on the outer circumferential surface of which helical splines are formed. The outer circumferential surface of the portion 3*c* of the output shaft 3 situated in front of the enlarged diameter portion 3*b* is plated, for example, with chromium along the entire axial length thereof. Further, the outer circumferential surface of the portion 3*c* of the output shaft 3 is covered by a resin coating 3*d* along the axial length thereof that is situated in front of the sleeve bearing 6*b* when the sleeve bearing 6*b* is slid to the front limit position with the pinion-carrying cylinder 6. The resin coating may be formed of a fluorocarbon resin such as polytetrafluoroethylene, polychlorotrifluoroethylene and the like, or it may be formed of an epoxy resin. The resin coating covers at least the portion of the output shaft 3 which projects from the front end of the pinion-carrying hollow cylinder 6 when the hollow cylinder 6 is at its rear limit position. This portion of the output shaft 3 is under most severe environment because the water splashed up by the running vehicle may easily reach this portion and dust is rapidly deposited thereon; thus, rust develops fastest on this portion of the output shaft 3. As the resin coating 3***d* according to the present invention covers at least this portion of the output shaft 3 on which rust most easily develops, the sliding difficulty of the pinion carrying cylinder 6 due to the development of rust on the output shaft 3 can be effectively prevented.

An axially slidable assembly, which includes the hollow shaft 4, overrunning clutch 5, pinion-carrying hollow cylinder 6 and pinion 6*a*, has a structure identical to that of the device of FIG. 1. Thus, the hollow shaft 4 disposed coaxially around the output shaft 3 has helical keyways at the inner circumferential surface thereof which engages the helical splines on the outer circumferential surface of the enlarged diameter portion 3*b* of the output shaft 3. The integral front end portion of the hollow shaft 4 constitutes an outer member 5*a* of the overrunning clutch 5. The integral rear end portion of the hollow cylinder 6 constitutes an inner member 5*c* of the clutch 5 which transmits a rotational force in one rotational direction through friction rollers 5*b* interposed between the outer member 5*a* and the inner member 5*c* thereof. The hollow cylinder 6 disposed coaxially around the output shaft 3 has a pinion 6*a* formed integrally at the front end thereof. The inner diameter of the front portion of the hollow cylinder 6 including the portion at which the pinion 6*a* is formed is reduced, so that water and dust will not easily enter the interior 6*h* of the hollow cylinder 6. A sleeve bearing 6*b* fitted to the inner circumferential surface of the hollow cylinder 6 supports it rotatably and axially slidably on the output shaft 3. Further, the hollow cylinder 6 is rotatably and axially slidably supported by the front housing frame 2*a* through an annular ball bearing 2*c* fixed thereto. A shift lever 8, when activated, urges the overrunning clutch 5 in a direction X to slide the axially slidable assembly in such a direction on the output shaft 3 that the pinion 6*a* is placed into engagement with a ring gear 7 of the associated engine (not shown).

The operation of the starter device of FIG. 3 is similar to that of the device of FIG. 1. Thus, when the shift lever 8 is activated to urge the overrunning clutch 5, the clutch 5 is slid, together with the hollow shaft 4 and the pinion-carrying hollow cylinder 6, in the forward axial direction X on the output shaft 3 to the front limit position at which the front end of the hollow shaft 6 abuts the stopper 3*a* and the pinion 6*a* engages the ring gear 7 of the associated engine (not shown). At the same time, the D.C. motor operatively connected with the output shaft 3 is energized and drives the output shaft 3, which in turn drives the hollow shaft 4 splined thereto. The rotation of the hollow shaft 4 is transmitted to the pinion-carrying hollow cylinder 6 through the overrunning clutch 5. Thus, the pinion 6*a* drives the ring gear 7 to start the engine. After the engine is started, the pinion 6*a* is rotated at a high speed by the ring gear 7 during the time in which the pinion 6*a* is still engaged therewith. However, the resulting high speed rotation of the hollow cylinder 6 is not transmitted to the output shaft 3 due to the one-way rotational force transmitting function of the overrunning clutch 5. After the engine is started to run stably, the axially slidable assembly is returned to the rear limit position, and the pinion 6*a* is disengaged from the ring gear 7.

Figure 4:
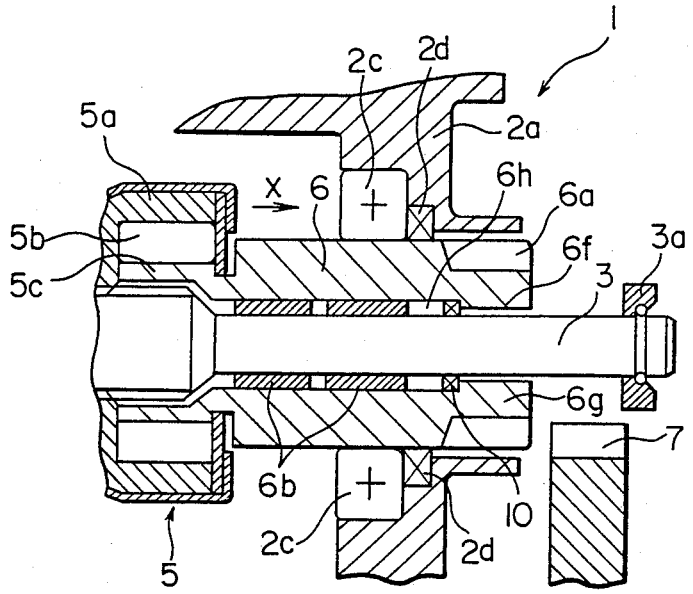
FIG. 4 is a view similar to that of FIG. 2, but showing the output portion of another starter device according to the present invention.

Referring now to FIG. 4 of the drawings, a second output structure of the starter device according to the present invention is described.

Figure 2:
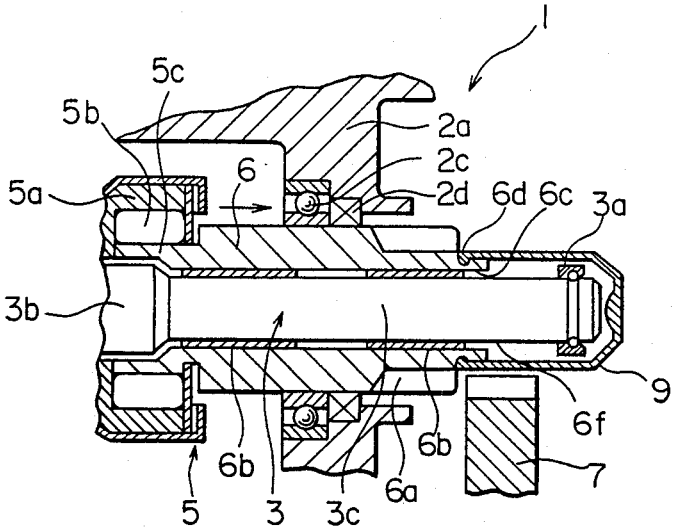
FIG. 2 PRIOR ART
FIG. 2 is a partial cross-sectional view of another conventional starter device, showing the axial cross section of the output portion thereof.

The structure of FIG. 4 is similar to that of FIG. 2 or FIG. 3. However, the inner diameter of the front end portion 6*g* of the pinion-carrying hollow cylinder 6 at which the pinion 6*a* is formed is reduced, compared with the inner diameter of the portion thereof at which the sleeve bearings 6*b* are fitted. Thus, the inner circumferential surface of the front end portion 6*g* under the teeth of the pinion 6*a* opposes the outer circumferential surface of the output shaft 3 with a small clearance 6*f* formed therebetween, and the portion 6*g* of the hollow cylinder 6 under the teeth of the pinion 6*a* has an enlarged thickness to enhance the mechanical strength of the pinion 6*a*. Further, an annular sealing member 10 in the form of, for example, an oil seal is attached to the inner circumferential surface of the hollow cylinder 6 so as to seal the opening formed between the outer circumferential surface of the output shaft 3 and the inner circumferential surface of the hollow cylinder 6. The sealing member 10 is positioned at the rear side of the front end portion 6*g* of a reduced inner diameter of the hollow cylinder 6, this axial position of the sealing member 10 being a position removed farthest from the bearings 6*b* in the forward direction. Due to the disposition of the sealing member 10 and the small clearance 6*f* between the output shaft 3 and the hollow cylinder 6, the entrance of water, dust and the like into the interior 6*h* of the hollow cylinder 6 through the front opening thereof can be prevented almost completely. By the way, in the case of the device of FIG. 4, two sleeve bearings 6*b* are disposed between the hollow cylinder 6 and the output shaft 3, and an annular oil seal 2*d* is mounted to the front housing frame 2*a* at the front side of the ball bearing 2*c* to seal the gap between the outer circumferential surface of the hollow cylinder 6 and the inner surface of the opening of the front housing frame 2*a* through which the hollow cylinder 6 extends. Otherwise, the structure and the operation of the device of FIG. 4 is similar to those of the devices described above.

Figure 5:
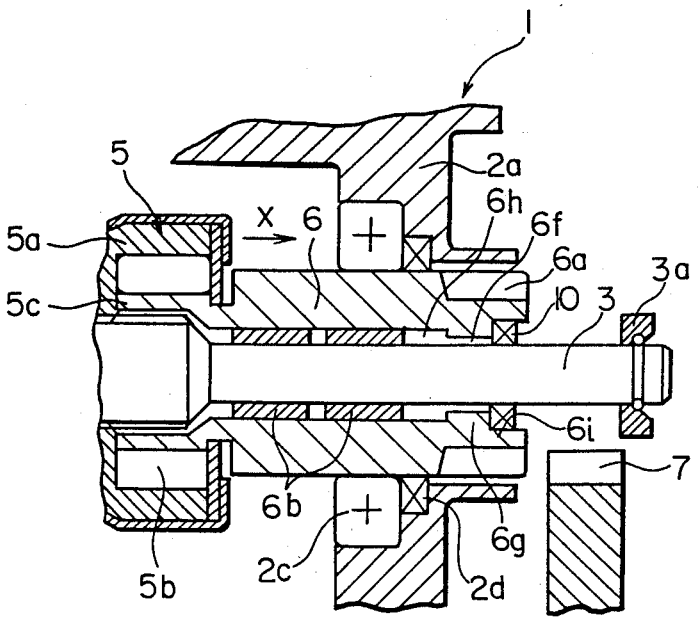
FIG. 5 is also a view similar to that of FIG. 2, but showing the output portion of a further starter device according to the present invention.

FIG. 5 shows a third embodiment of the starter device according to the present invention which is substantially identical to the device of FIG. 4. In the case of the device of FIG. 5, however, the pinion-carrying hollow cylinder 6 comprises a portion 6*i* of an enlarged inner diameter in front of the reduced inner diameter portion 6*g*, and the annular sealing member 10 is mounted to the enlarged inner diameter portion of the hollow cylinder 6 in such a manner as to be interposed between the inner circumferential surface of the enlarged inner diameter portion of the hollow cylinder 6 and the outer circumferential surface of the output shaft 3 for sealing the opening between the output shaft 3 and the hollow cylinder 6. Otherwise, the structure and the operation of the device of FIG. 5 is identical to those of the device of FIG. 4.

What is claimed is:

1. A starter device for an internal combustion engine, comprising:

a housing;

an output shaft rotatably supported by said housing;

drive means for driving said output shaft in one rotational direction;

a hollow shaft member disposed coaxially around said output shaft, said hollow shaft member being splined to said output shaft so as to slidable in the axial direction of said output shaft;

a hollow cylindrical member disposed coaxially around said output shaft at a front side of said hollow shaft member, said hollow cylindrical member having a portion, opposite the side near the hollow shaft member, at which the inner diameter thereof is reduced;

a pinion formed at the front end of said hollow cylindrical member at which the inner diameter thereof is reduced, said pinion being placed into driving engagement with a ring gear of said internal combustion engine when said hollow cylindrical member is slid to a front position on said output shaft;

bearing means coupled to an inner circumferential surface of said hollow cylindrical member for rotatably supporting said hollow cylindrical member around said output shaft, said bearing means allowing said hollow cylindrical member to slide in the axial direction of the output shaft;

one-way clutch means for sliding said hollow shaft member to said hollow cylindrical member for transmitting a rotational force in one rotational direction;

sliding means for sliding said hollow cylindrical member, together with said hollow shaft member, in the axial direction on said output shaft between a rear and a front axial limit position; and a rust-preventive coating provided on an outer circumferential surface of said output shaft along an axial length which is situated axially in front of said bearing means when said hollow cylindrical member is slid to said front axial limit position, said axial length provided with said rust-preventive coating including at least a portion of said output shaft which projects out of said hollow cylindrical member when said hollow cylindrical member is at said rear axial limit position whereby sliding contact between said output shaft and said hollow cylindrical member is facilitated.

2. A starter device for an internal combustion engine as claimed in claim 1, wherein said bearing means comprises a sleeve bearing fitted to an inner circumferential surface of said hollow cylindrical member, said sleeve bearing being coaxially and rotatably disposed around said output shaft so as to be slidable in the axial direction of said output shaft.

3. A starter device for an internal combustion engine as claimed in claim 1, wherein said sliding means comprises shift lever means for urging said one-way clutch means in the axial direction to slide said hollow shaft member and said hollow cylindrical member on said output shaft.

4. A starter device for an internal combustion engine as claimed in claim 1, wherein said rust-preventive coating is formed of an organic material.

5. A starter device for an internal combustion engine as claimed in claim 4, wherein said organic material comprises a resin selected from the group consisting of fluorocarbon resins and epoxy resins.

6. A starter device for an internal combustion engine, comprising:

a housing;

an output shaft rotatably supported by said housing;

drive means for driving said output shaft in one rotational direction;

a hollow shaft member disposed coaxially around said output shaft, said hollow shaft member being splined to said output shaft so as to be slidable in the axial direction of said output shaft;

a hollow cylindrical member disposed coaxially around said output shaft at a front side of said hollow shaft member, said hollow cylindrical member having a front portion and a rear portion, said rear portion is proximate to said hollow shaft member, an inner diameter of said front portion is reduced with respect to an inner diameter of said rear portion.

a pinion formed at said front portion of said hollow cylindrical member, said pinion being placed into driving engagement with a ring gear of said internal combustion engine when said hollow cylindrical member is slid to a front position on said output shaft;

bearing means coupled to an inner circumferential surface of said hollow cylindrical member for rotatably supporting said hollow cylindrical member around said output shaft, said bearing means allowing said hollow cylindrical member to slide in the axial direction of the output shaft;

one way clutch means connecting said hollow shaft member to said hollow cylindrical member for transmitting a rotational force in one rotational direction;

sliding means for sliding said hollow cylindrical member, together with said hollow shaft member, in the axial direction on said output shaft; and an annular sealing member interposed between an inner circumferential surface of said hollow cylindrical member and an outer circumferential surface of said output shaft, said sealing member being coaxially disposed around said output shaft at an axial position between said bearing means and said reduced inner diameter of said front portion.

7. A starter device for an internal combustion engine as claimed in claim 6, wherein said bearing means comprises a sleeve bearing fitted to an inner circumferential surface of said hollow cylindrical member, said sleeve bearing being coaxially and rotatably disposed around said output shaft so as to be slidable in the axial direction of the output shaft.

8. A starter device for an internal combustion engine as claimed in claim 6, wherein said sliding means comprises shift lever means for urging said one-way clutch means in the axial direction to slide said hollow shaft member and said hollow cylindrical member on said output shaft.

9. A starter device as claimed in claim 6, wherein said hollow cylindrical member further comprises a portion at which the inner diameter thereof is enlarged, the enlarged inner diameter portion of said hollow cylindrical member being situated axially in front of said reduced inner diameter portion; and said sealing member is fitted to an inner circumferential surface of said enlarged inner diameter portion of said hollow cylindrical member.

10. A starter device as claimed in any one of the claim 6, wherein said sealing member comprises an oil seal.

* * * * *